US007575238B1

(12) United States Patent
Miller et al.

(10) Patent No.: US 7,575,238 B1
(45) Date of Patent: Aug. 18, 2009

(54) SENATE CARD GAME

(76) Inventors: Jackson R. Miller, 12027 N. 56th St., Phoenix, AZ (US) 85254; Mary M. Miller, 12027 N. 56th St., Phoenix, AZ (US) 85254

( * ) Notice: Subject to any disclaimer, the term of this patent is extended or adjusted under 35 U.S.C. 154(b) by 342 days.

(21) Appl. No.: 11/531,663

(22) Filed: Sep. 13, 2006

(51) Int. Cl.
*A63F 1/00* (2006.01)
*A63F 9/20* (2006.01)
*A63F 3/00* (2006.01)

(52) U.S. Cl. ..... 273/292; 273/257; 273/306; 273/243; 273/303

(58) Field of Classification Search ..... 273/292, 273/257, 303, 243, 306
See application file for complete search history.

(56) References Cited

U.S. PATENT DOCUMENTS 6,254,099 B1 * 7/2001 Pederson ..... 273/292
6,921,075 B2 * 7/2005 Moore ..... 273/292

* cited by examiner

*Primary Examiner*—Gene Kim
*Assistant Examiner*—Michael D Dennis
(74) *Attorney, Agent, or Firm*—Schmeiser, Olsen & Watts LLP

(57) ABSTRACT

A senate card game having a plurality of senate cards. The plurality of senate cards may be at least one of Senator cards, a President card, and a Vice President card. The Senator cards are configured to flip over to show a value of each card determined by value factors including at least one of office, class, year, electoral count and combinations thereof, wherein a card of greater value wins a card of lesser value. Play of the game may continue for a predetermined amount of time wherein cards are flipped and won dependent upon the value of each card flipped. The player with the greatest number of cards may then proceed to win and submit a bill. The winner may also be determined by whether a submitted bill is passed or overridden. Play of the game may also include parliamentary strategies to gain particular advantages throughout the game.

12 Claims, 6 Drawing Sheets

SENATE CARD GAME

BACKGROUND OF THE INVENTION

1. Technical Field

This invention relates generally to a card game and more particularly to an educational senate card game correlating to the operation and function of the senate.

2. State of the Art

There are various types of games that provide fun for players. Further there are various types of games that also serve as an educational tool to teach players information based on various subject matters and topics. Common types of games include card games that have bidding, comparing, matching and the like.

Conventional card games include games wherein cards are compared for relative value, wherein the higher valued card or set of cards wins the particular hand, trick and the like. However, these games have their limitations.

Conventional card games are lacking in the ability to assess values to the cards based on roles of Senators in Congress, roles of the executive branch and the like. Further, conventional card games do not educate on how Congress functions and the role of each Senator within Congress, including, but not limited to, state of representation and office held by the Senator.

Additionally, conventional card games are lacking in the ability to have various levels of play dependent on the age, skill level and knowledge of the players for example. Typically, conventional card games have one basic or common version of play that is standard for who ever is playing regardless of age, skill level and the like.

Accordingly, there is a need in the field of card games for an improved card game relating to and providing education about Senators and Congress.

DISCLOSURE OF THE INVENTION

The present invention relates to a senate card game correlating to the operation and function of the senate. The senate card game may also provide teaching players how the senate functions, the various Senators in the senate, the states each Senator represents, each Senator's party affiliation, the electoral votes of each state, as well as the role of the President and Vice President with respect to the senate.

An aspect of the present invention may include a method of playing a senate card game, the method comprising the step of separating senate cards into stacks, wherein the separation is dependent upon political parties. The method of playing a senate card game may also include steps of placing each stack of senate cards face down and flipping a card from a top of each stack showing the Senator of each card flipped. Further, embodiments of the method of playing the senate card game may include winning a card of lesser value, wherein the value of each card is determined by value factors including at least one of office, class, year, electoral count and combinations thereof.

Another aspect of the present invention may include a method of playing a senate card game, the method comprising the step of establishing rules of trading from a set of rules. The set of rules may include trading any senate card with a particular class of Senator for any other senate card with the same particular class of Senator and trading a senate card with a Senator of a player's state of residence for any other senate card with a Senator of another state. Further, the set of rules may further include trading any senate card with any Senator of any state of any party for any other Senator card with a Senator and trading senate cards of one Congress with senate cards of another Congress.

Yet another aspect of the present invention may include a senate card game comprising a plurality of senate cards, the plurality of senate cards being at least one of Senator cards, a President card, and a Vice President card. The Senator cards may be configured to flip over to show a value of each card determined by value factors including at least one of office, class, year, electoral count and combinations thereof. The card of greater value wins the card of lesser value. Each of the plurality of senate cards may also indicate a political party.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a senate card game correlating to the operation and function of the senate. The senate card game may also provide teaching of players more about how the senate functions, the various Senators in the senate, the state each Senator represents, each Senator's party affiliation, the electoral votes of each state, as well as the role of the President and Vice President with respect to the senate.

Figure 1:
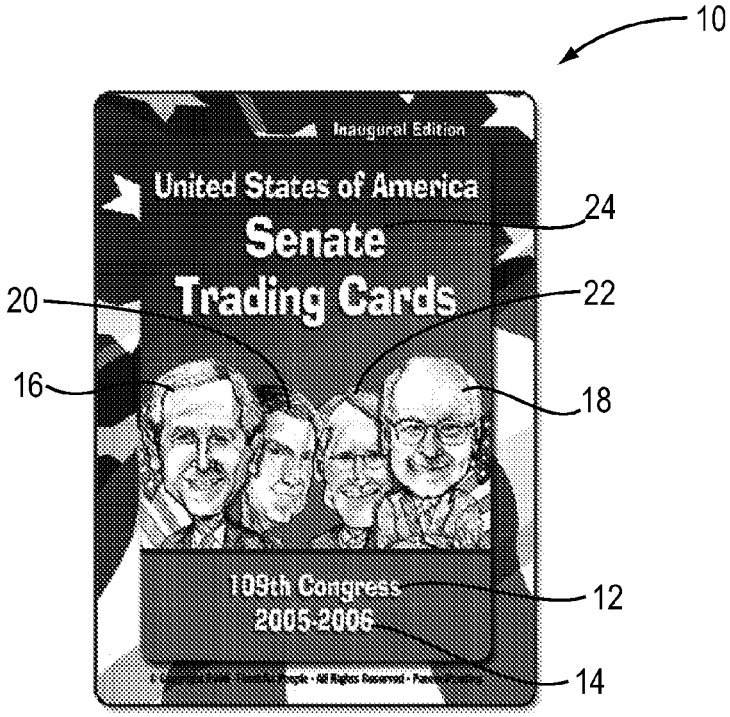
FIG. 1 is a plan view of a back side of a senate card in accordance with the present invention.

Referring to the drawings, FIG. 1 depicts a plan view of a back side 11 of a senate card 10 in accordance with embodiments of the present invention. The back side 11 may include a Congress session designation 12, the year 14 of the Congress session, and a title 24 of the senate game. Further, the back side 11 of the senate card 10 may further include depictions of a President of the United States 16, a Vice President of the United States 18, a Senate Majority Leader 20 and a Senate Minority Leader 22. For example and without limitation, the back side 11 of a senate card 10 may include a Congress 12 of the "109$^{th}$ Congress" in a year 14 of "2005-2006". The title 24 may be "Senate Trading Cards." The President 16 may be "George W. Bush," the Vice President may be "Richard Cheney," the Senate Majority Leader 20 may be "William Frist," and the Senate Minority Leader 22 may be "Harry Reid."

It will be understood by those of ordinary skill in the art that with each Congress session 12, the information on the back side 11 of the senate card 10 may change in accordance with changes in each subsequent Congress, for example and without limitation, the Congress session 12 and year 14 will change numerically, the President 16, Vice President 18, Majority Leader 18 and Minority Leader 20 may each change according to who is holding office during the Congress session 12 and year 14.

Figure 2:
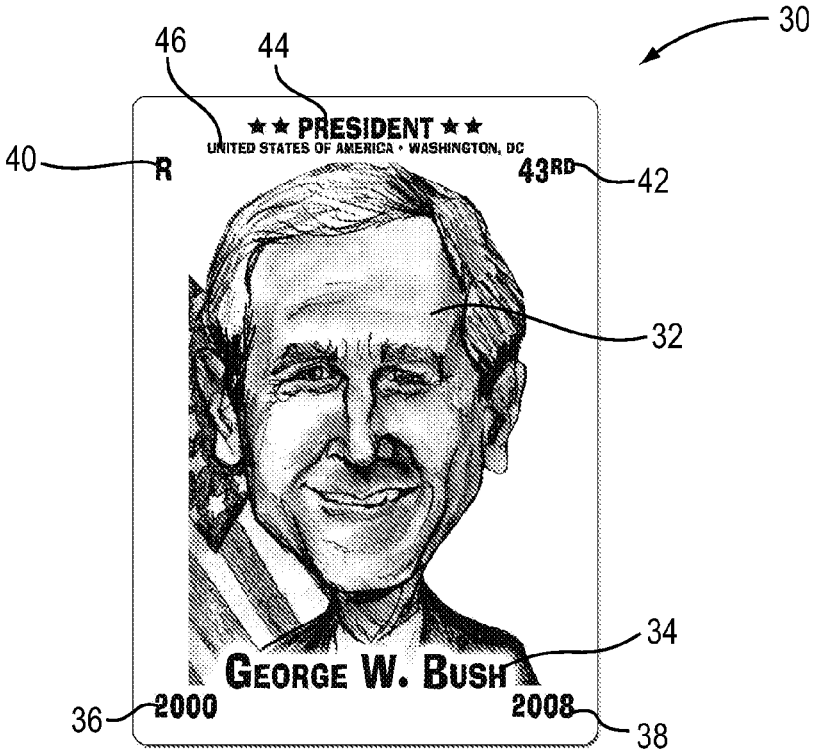
FIG. 2 is a front view of a President card in accordance with the present invention.

Referring again to the drawings, FIG. 2 depicts a front view of a President card 30 according to embodiments of the present invention. The President card 30 may include a depiction 32 of a President, a name 34 of the President, the beginning year 36 of the President's term, the ending year 38 of the President's term, the party designation 40 and the President number 42. Further, the President card 30 may include the executive office designation 44 and the country 46. For example and without limitation, the President card 30 may include a depiction 32 of George W. Bush, a name 34 of "George W. Bush," a beginning year 36 of "2000," an ending year 38 of "2008," a party 40 of "R" for republican, a President number 42 of "43rd," an office designation 44 of "President," and a country 46 of "United State of America."

It will be understood by those of ordinary skill in the art that with each change in the President of the United States, the information on the President card 30 may change in accordance with changes in each subsequent Congress, for example and without limitation, the President depiction 32, name 34, beginning year 36, ending year 38, party 40 and President number 42 may all change each time a new President takes office. Regardless of the information found on the President card 30, the card 30 functions the same and has the same duties and role within the senate card game.

Figure 3:
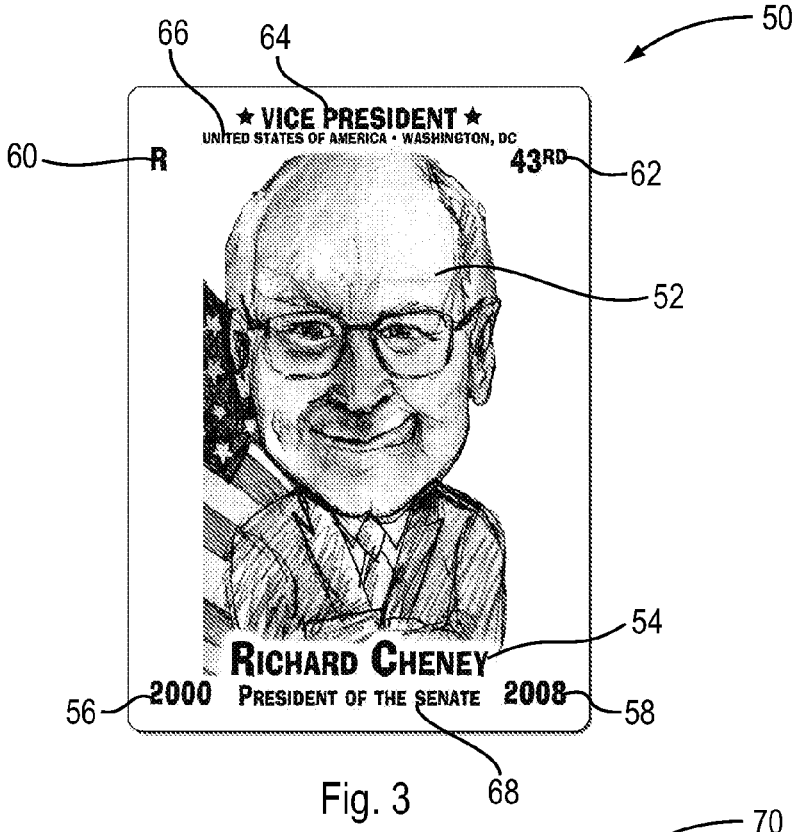
FIG. 3 is a front view of a Vice President card in accordance with the present invention.

Referring again to the drawings, FIG. 3 depicts a front view of a Vice President card 50 according to embodiments of the present invention. The Vice President card 50 may include a depiction 52 of a Vice President, a name 54 of the Vice President, the beginning year 56 of the Vice President's term, the ending year 58 of the Vice President's term, the party designation 60 and the Vice President number 62. Further, the Vice President card 50 may include the executive office designation 64, the country 66 and the senate office 68. For example and without limitation, the Vice President card 50 may include the depiction 52 of Richard Cheney, the name 54 of "Richard Cheney," the beginning year 56 of "2000," the ending year 58 of "2008," the party 60 of "R" for republican, the Vice President number 62 of "43rd," the office designation 64 of "Vice President," the country 66 of "United State of America," and the senate office 68 of "President of the Senate."

It will be understood by those of ordinary skill in the art that with each change in the Vice President of the United States, the information on the Vice President card 50 may change in accordance with changes in each subsequent Congress, for example and without limitation, the Vice President depiction 52, name 54, beginning year 56, ending year 58, party 60 and Vice President number 62 may all change each time a new Vice President takes office. Regardless of the information found on the Vice President card 50, the card 50 functions the same and has the same duties and role within the senate card game.

Figure 4:
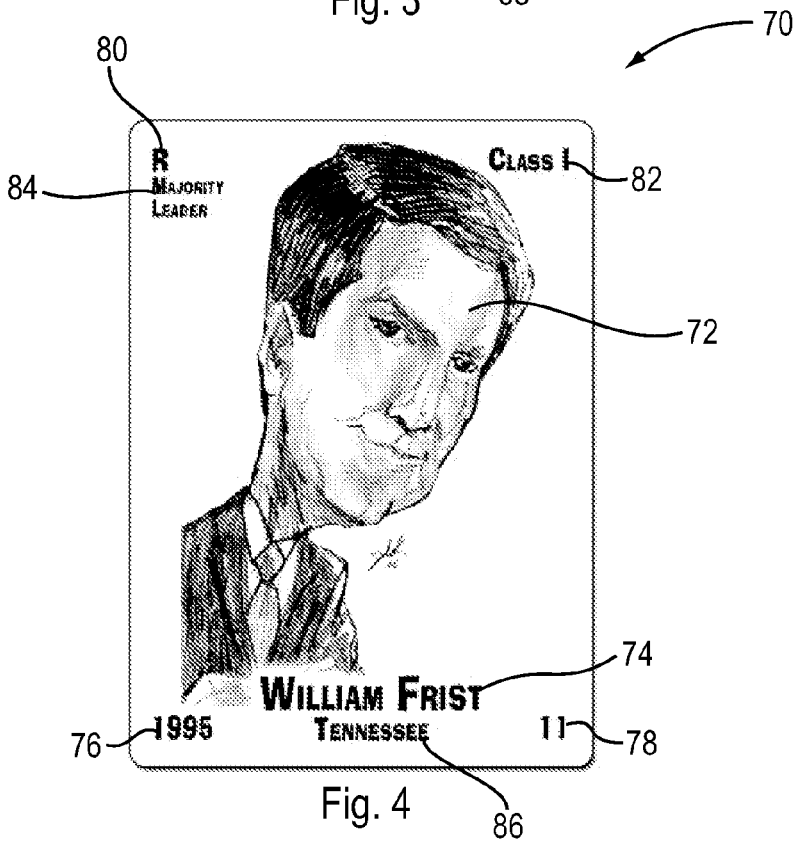
FIG. 4 is a front view of a Majority Leader card in accordance with the present invention.

FIG. 4 depicts a front view of a Majority Leader card 70 according to embodiments of the present invention. The Majority Leader card 70 may include a depiction 72 of a Majority Leader, a name 74 of the Majority Leader, an entering year 76 of the Majority Leader entered the Senate, an electoral count 78 of the Majority Leader's state 86, a party designation 80, a class 82 and a Senate office 84. For example and without limitation, the Majority Leader card 70 may include the depiction 72 of William Frist, the name 74 of "William Frist," the entering year 76 of "1995," the electoral count 78 of "11" for the state 86 of "Tennessee," the party 80 of "R" for republican, the class 82 of "Class I," and the senate office 84 of "Majority Leader."

It will be understood by those of ordinary skill in the art that with each new Congress session, the information on the Majority Leader card 70 may change in accordance with each subsequent Congress. For example and without limitation, the Majority Leader depiction 72, name 74, entering year 76, electoral count 78, party 80, class 82 and state 86 may all change each time a new Majority Leader takes office. Regardless of the information found on the Majority Leader card 70, the card 70 functions the same and has the same duties and role within the senate card game.

Figure 5:
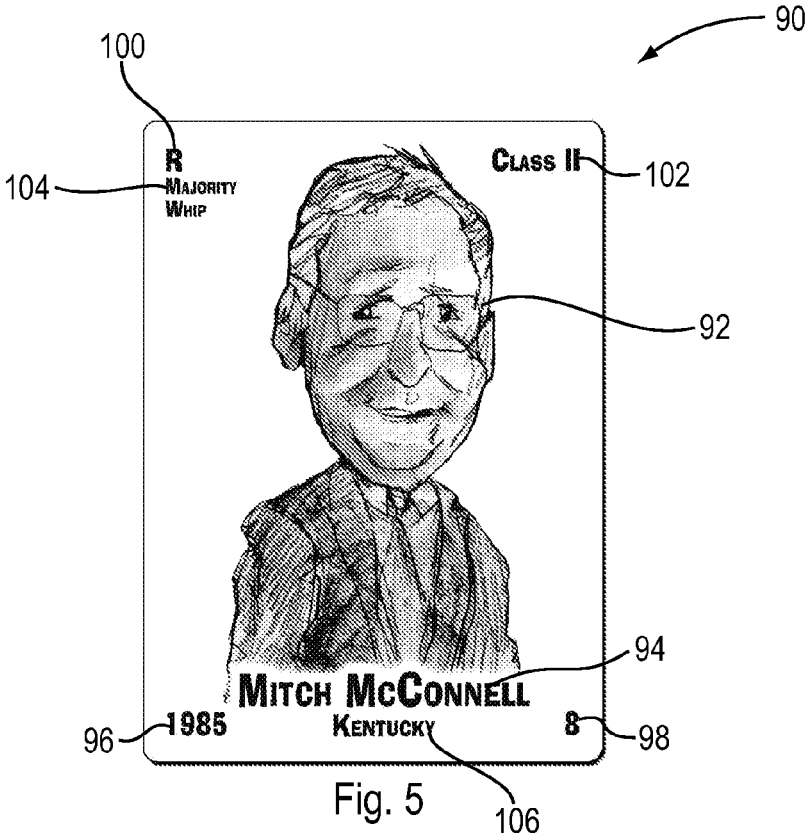
FIG. 5 is a front view of a Majority Whip card in accordance with the present invention.

FIG. 5 depicts a front view of a Majority Whip card 90 according to embodiments of the present invention. The Majority Whip card 90 may include a depiction 92 of a Majority Whip, a name 94 of the Majority Whip, an entering year 96 the Majority Whip entered the Senate, an electoral count 98 of the Majority Whip's state 106, a party designation 100, a class 102 and a Senate office 104. For example and without limitation, the Majority Whip card 90 may include the depiction 92 of Mitch McConnell, the name 94 of "Mitch McConnell," the entering year 96 of "1985," the electoral count 98 of "8" for the state 106 of "Kentucky," the party 100 of "R" for republican, the class 102 of "Class II," and the senate office 104 of "Majority Whip."

It will be understood by those of ordinary skill in the art that with each new Congress session, the information on the Majority Whip card 90 may change in accordance with each subsequent Congress. For example and without limitation, the Majority Whip depiction 92, name 94, entering year 96, electoral count 98, party 100, class 102 and state 106 may all change each time a new Majority Whip takes office. Regardless of the information found on the Majority Whip card 90, the card 90 functions the same and has the same duties and role within the senate card game.

Figure 6:
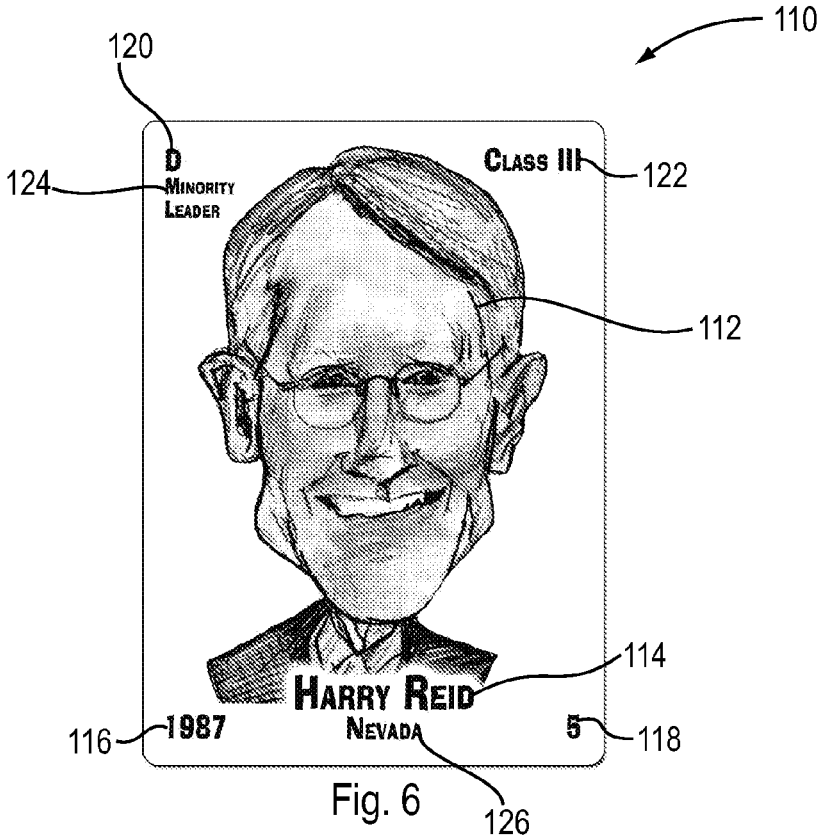
FIG. 6 is a front view of a Minority Leader card in accordance with the present invention.

FIG. 6 depicts a front view of a Minority Leader card 110 according to embodiments of the present invention. The Minority Leader card 110 may include a depiction 112 of a Minority Leader, a name 114 of the Minority Leader, an entering year 116 of the Minority Leader entered the Senate, an electoral count 118 of the Minority Leader's state 126, a party designation 120, a class 122 and a Senate office 124. For example and without limitation, the Minority Leader card 110 may include the depiction 112 of Harry Reid, the name 114 of "Harry Reid," the entering year 116 of "1987," the electoral count 118 of "5" for the state 126 of "Nevada," the party 120 of "D" for democrat, the class 122 of "Class III," and the senate office 124 of "Minority Leader."

It will be understood by those of ordinary skill in the art that with each new Congress session, the information on the Minority Leader card 110 may change in accordance with each subsequent Congress. For example and without limitation, the Minority Leader depiction 112, name 114, entering year 116, electoral count 118, party 120, class 122 and state 126 may all change each time a new Minority Leader takes office. Regardless of the information found on the Minority Leader card 110, the card 110 functions the same and has the same duties and role within the senate card game.

Figure 7:
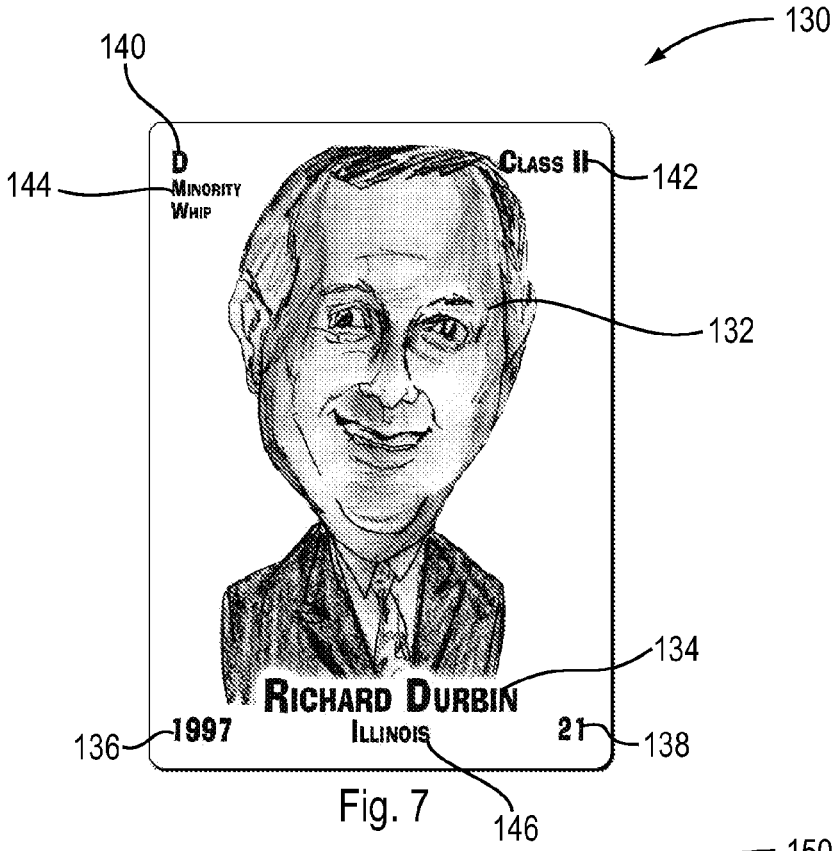
FIG. 7 is a front view of a Minority Whip card in accordance with the present invention.

FIG. 7 depicts a front view of a Minority Whip card 130 according to embodiments of the present invention. The Minority Whip card 130 may include a depiction 132 of a Minority Whip, a name 134 of the Minority Whip, an entering year 136 the Minority Whip entered the Senate, an electoral count 138 of the Minority Whip's state 146, a party designation 140, a class 142 and a Senate office 144. For example and without limitation, the Minority Whip card 130 may include the depiction 132 of Richard Durbin, the name 134 of "Richard Durbin," the entering year 136 of "1997," the electoral count 138 of "21" for the state 146 of "Illinois," the party 140 of "D" for democrat, the class 142 of "Class II," and the senate office 144 of "Minority Whip."

It will be understood by those of ordinary skill in the art that with each new Congress session, the information on the Minority Whip card 130 may change in accordance with each subsequent Congress. For example and without limitation, the Minority Whip depiction 132, name 134, entering year 136, electoral count 138, party 140, class 142 and state 146 may all change each time a new Minority Whip takes office. Regardless of the information found on the Minority Whip card 130, the card 130 functions the same and has the same duties and role within the senate card game.

Figure 8:
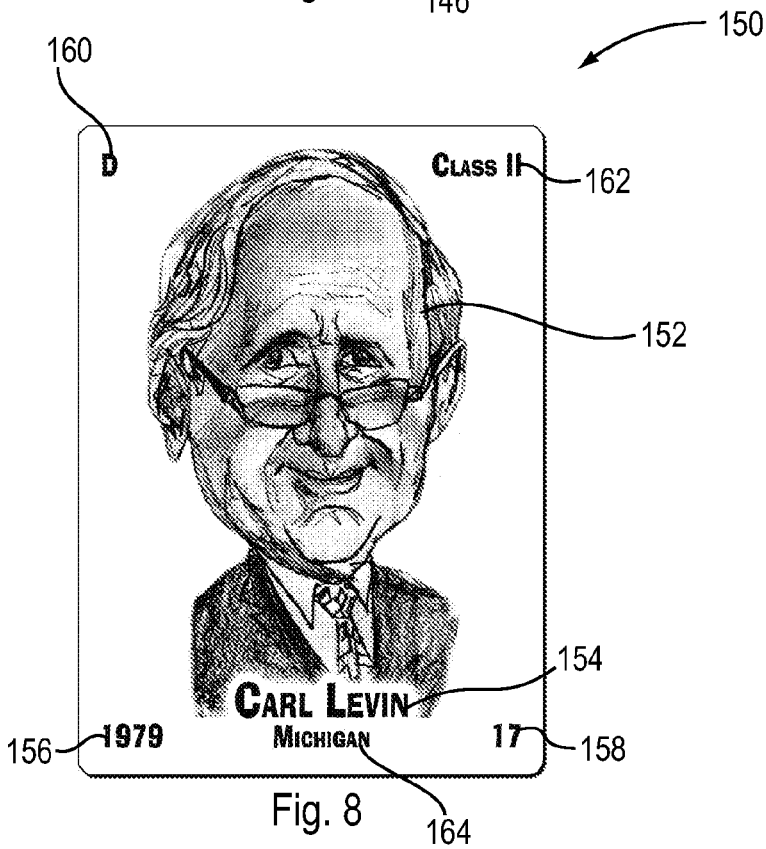
FIG. 8 is a front view of a Senator card in accordance with the present invention.

FIG. 8 depicts a front view of a Senator card 130 according to embodiments of the present invention. The Senator card 150 may include a depiction 152 of a Senator, a name 154 of the Senator, an entering year 156 the Senator entered the Senate, an electoral count 158 of the Senator's state 164, a party designation 160 and a class 162. For example and without limitation, the Senator card 150 may include the depiction 152 of Carl Levin, the name 154 of "Carl Levin," the entering year 156 of "1979," the electoral count 158 of "17" for the state 166 of "Michigan," the party 160 of "D" for democrat and the class 162 of "Class II."

It will be understood by those of ordinary skill in the art that with each new Congress session, the information on each Senator card 150 may change in accordance with each subsequent Congress. For example and without limitation, the Senator card 150 for a Senator from a particular state may have the depiction 152, name 154, entering year 156, electoral count 158, party 160 and class 162 all change each time a new Senator takes office from that particular state 164. Regardless of the information found on the Senator card 150, the card 150 functions the same and has the same duties and role within the senate card game.

Figure 9:
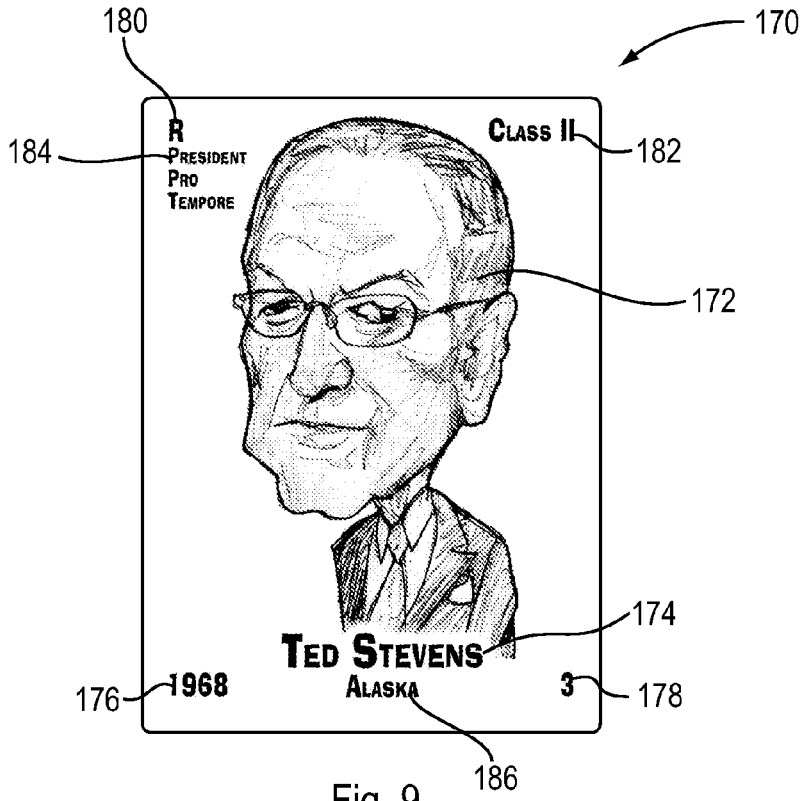
FIG. 9 is a front view of a President Pro Tempore card in accordance with the present invention.

FIG. 9 depicts a front view of a President Pro Tempore card 170 according to embodiments of the present invention. The President Pro Tempore card 170 may include a depiction 172 of a President Pro Tempore, a name 174 of the President Pro Tempore, an entering year 176 the President Pro Tempore entered the Senate, an electoral count 178 of the President Pro Tempore's state 186, a party designation 180, a class 182 and a Senate office 184. For example and without limitation, the President Pro Tempore card 170 may include the depiction 172 of Ted Stevens, the name 174 of "Ted Stevens," the entering year 176 of "1968," the electoral count 178 of "3" for the state 186 of "Alaska," the party 180 of "R" for republican, the class 182 of "Class II," and the senate office 184 of "President Pro Tempore."

It will be understood by those of ordinary skill in the art that with each new Congress session, the information on the President Pro Tempore card 170 may change in accordance with each subsequent Congress. For example and without limitation, the President Pro Tempore depiction 172, name 174, entering year 176, electoral count 178, party 180, class 182 and state 186 may all change each time a new President Pro Tempore takes office. Regardless of the information found on the President Pro Tempore card 170, the card 170 functions the same and has the same duties and role within the senate card game.

Figure 10:
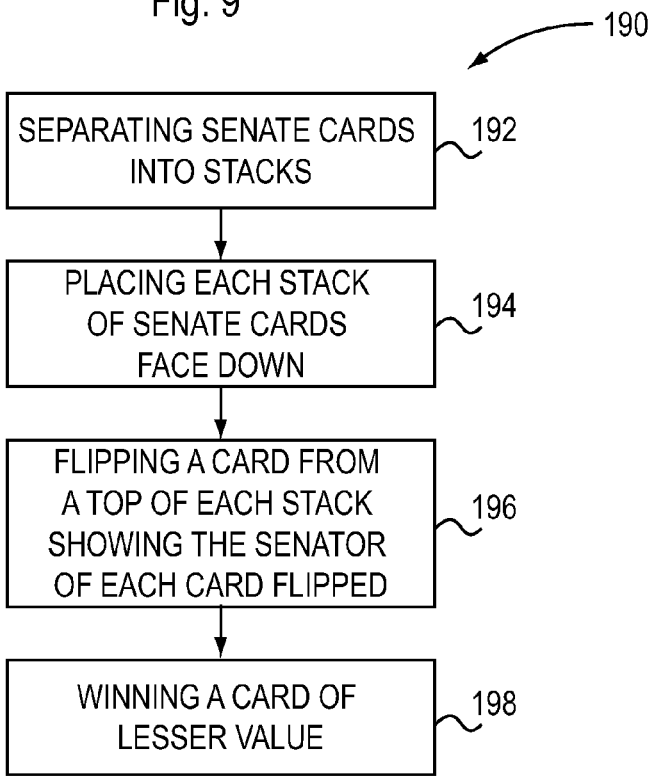
FIG. 10 is a flow chart of a method of playing a senate card game in accordance with the present invention.

Particular embodiments of the present invention, as shown in FIG. 10, may include a method 190 of playing a senate card game. The method 190 may comprise the steps of separating senate cards into stacks (Step 192), wherein the separation is dependent upon political parties. For example one stack may be for Republicans and another stack for Democrats. It will be understood that when there are various different parties, such as Independents, they may be grouped with or associated with the majority party of either the republican or democratic parties. The method 190 may further include placing each stack of senate cards face down (Step 194). The stacks may be placed face down on a playing surface that is designated as the senate floor. The method may further include steps of flipping a card from a top of each stack showing the Senator of each card flipped (Step 196) and winning a card of lesser value (Step 198), wherein the value of each card is determined by value factors including at least one of office, class, year, electoral count and combinations thereof. The method 190 may further include the step of placing the flipped cards face down in a second stack on the side of the player with the card of higher value. The second stack may also be referred to as the committee.

According to embodiments of the present invention, the value of each card determined by office may include at least, in order of greatest value to least value, President, Vice President, Majority Leader, Majority Whip, Minority Leader, Minority Whip, and President Pro Tempore. The value of each card determined by class may include at least, in order of greatest value to least value, Senator class I, Senator class II, and Senator class III. The value of each card determined by electoral count may include a value assigned to a senate card equal to the number of electoral votes of the state represented by a Senator on the senate card. The value of each card determined by year includes a value assigned to a senate card dependent on a year a Senator on a senate card entered senate office, wherein the year that is the earliest has a greater value.

Referring further to the method 190 of playing the senate card game, Step 198 of winning a card of lesser value may include a preliminary step of establishing a rotation or order of the value factors considered to determine which card has a greater value. For example, and without limitation, the order may be class, year, electoral count; class, electoral count, year; year, electoral count, class; year, class electoral count; electoral count, year, class; and electoral count, class, year. In particular embodiments, the method 190 of playing the game may incorporate the office of the Senator depicted on a card as part of the rotation in determining the higher valued card.

In particular instances during the method 190 of playing the game a tie may occur. In such instances, the method 190 may further include performing a tie breaker if cards flipped over have equal value, the tie breaker being determined by a Vice President card, wherein the card flipped having the same party as the Vice President card is determined the winner.

Step 192 of separating the senate cards into stacks according to the method of playing the senate card game may further include the steps of removing a Majority Leader card, a Majority Whip card, a Minority Leader card and a Minority Whip card from the senate cards; and placing the Majority Leader card, the Majority Whip card the Minority Leader card and the Minority Whip card face up in a predetermined area. Further, the President Pro Tempore card may be removed and shown to the opposing player and placed face down anywhere in the majority party stack and the player having the stack of minority party cards may designate one card to be his or her President Pro Tempore card and place it face down in the minority party stack.

The offices of these cards have various other capabilities within the game. Each of the Majority Leader card, a Majority Whip card, a Minority Leader card and a Minority Whip card can be used to filibuster or perform "an unlimited debate." Filibusters are used to delay or block Senate action. This may only be called four times in the game, once by each the Majority Leader card, a Majority Whip card, a Minority Leader card and a Minority Whip card. The player designates which of his Majority or Minority Leaders and/or Whips is filibustering. Each player takes the next six cards from his stack on the Senate floor and puts them face down into a pot or group of cards. The next Senator card from the players' stacks on the Senate floor is turned over. The card of highest value takes all 12 cards. They are put face down on the bottom of the winning side's committee. The Majority Leader card, a Majority Whip card, a Minority Leader card and a Minority Whip card that called the filibuster may be removed and placed on the bottom of his party's stack on the Senate floor.

The player who did not call the filibuster may exercise the option to utilize a cloture or a procedure used to force the end of a filibuster. A ⅗ vote of the opposition is needed to block a filibuster. The player who did not call the filibuster may call for cloture if he has 60 Senators in his stack on the Senate floor. The player counts only the cards on the Senate floor. The cards may be kept in order and counted face down. Once the filibuster is called, the particular Leader or Whip cannot call for a filibuster again. A cloture may be called prior to the filibuster procedure of turning six cards over.

The President Pro Tempore cards may be used to call a quorum. A quorum is the minimum number of Senators needed to conduct Senate business. The call for a quorum can only be used once by each President Pro Tempore card. This call for a quorum is for a count of the total number of Senators present on both sides of the Senate. The total Senate is to have 51 Senators on the Senate floor or designated playing area to do the work of the Senate. When a Senator is in committee or in a won stack of a player, he is not on the Senate floor. Both sides count only the stack of cards on the Senate floor that are face down as well as the two cards in play. The order of the cards may not be changed. If there are not 51 cards in total on both sides, the player calling for a quorum may draw a card from anywhere in the opposite side's committee floor. That Senator card may then be placed at the bottom of the player's stack on the Senate floor who called the quorum. If both players' designated President Pro Tempore are turned simultaneously, their cards are put on the top of each player's committee and the call for a quorum is not used. Play resumes with the next two Senator cards turned over from the stack on the floor. A quorum may be called the next time a player's designated President Pro tempore is played. If a player loses his designated President to the other side, none other can be designated. If a player wins back that officer, a quorum can be called when that Senator is played. Once the President Pro Tempore calls a quorum, that Senator no longer holds that office and the card is played as a typical Senator card in accordance with the method for playing the senate card game. A quorum cannot be called during a filibuster.

In particular embodiments of the present invention, the method 190 of playing the senate card game may further comprise a preliminary step of trading senate cards having Senators with a predetermined class for other senate cards having Senators with the same predetermined class. This allows various versions of game play, particularly as additional Congresses are in session beginning with the 109$^{th}$ Congress. For example, Senator cards from the 109$^{th}$ Congress may be traded for Senator cards of the 110$^{th}$ Congress, 111$^{th}$ Congress and the like. This allows a player to assemble his or her desired Senate and then proceed to game play.

The method 190 of playing the senate card game may further comprise the step of determining a winner, wherein the winner is the player with the most senate cards at the expiration of the predetermined time of game play. The method 190 may further include additional methods of play that may include the step of determining a bill submitting party after a predetermined time of game play by a player having ⅔ of the senate cards on the player's side. After the expiration of the predetermined time of game play, the player having at least ⅔ of the senate cards is designated the bill submitting party and may further submit a bill for approval. Once a bill is submitted the method 190 of playing the senate card game may further comprise performing an action by a President card of passing the bill or vetoing the bill. According to particular embodiments of the present invention, the bill passes if the submitting party is the same party as the President card and the bill is vetoed if the submitting party is a different party as the President card. The vetoed bill may be overridden if ⅔ of the senate cards in play indicates a party that is the same as the President card. Further, according to particular embodiments of method 190, the winning player may be determined as at least one of the submitting party that successfully passes the bill and the player that overrides the bill.

Particular embodiments of the method 190 of playing the senate card game may include other strategic plays such as, but not limited to, censure and expulsion. Censure is a Senate statement of disapproval of a Senator, not removal from office. At any time, any Senator may call for the censure of another Senator if he has ⅔ of the Senator cards on the Senate floor. As both sides turn up their top cards, one side may call for a censure of the opposing Senator in play on the floor. The total Senate floor, which includes both players' stacks of senate cards, is counted face down and without changing rotation. If there are ⅔ of the Senator cards on the floor, the censured Senator goes to the bottom of his side's committee. He is not moved from his side of the Senate.

Expulsion is the Senate removal of a Senator from office for disorderly behavior. If a player thinks there are ⅔ of all the Senator cards present on both sides or stacks of cards of the Senate floor, he may name and call for the expulsion of any Senator. Both Senate floors are counted and if the total present is 66 Senators or more, the Senator named is removed from the game and placed face up outside of the Senate floor. Expulsion may be called for only once in a game by each side.

Figure 11:
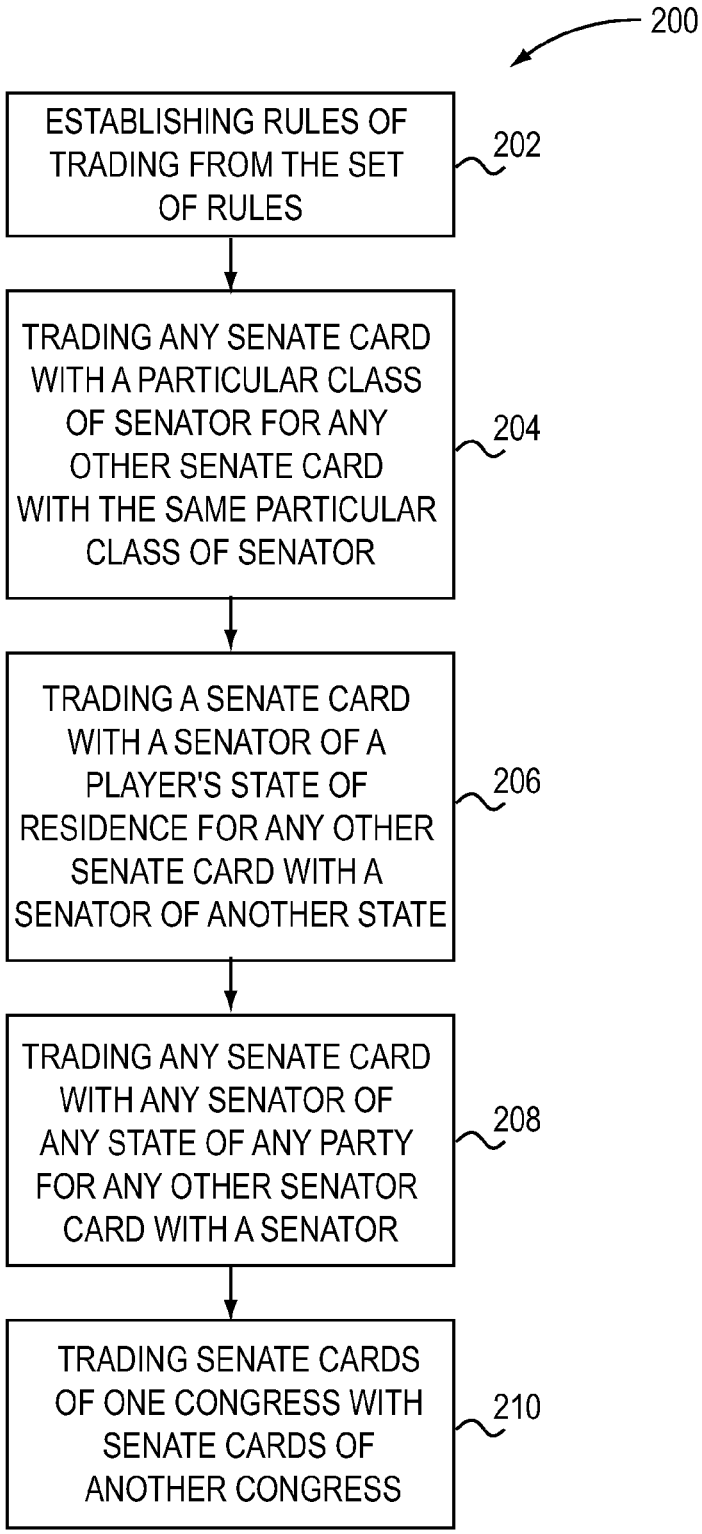
FIG. 11 is a flow chart of another embodiment of a method of playing a senate card game in accordance with the present invention.

Referring to FIG. 11 and in accordance with another particular embodiment of the present invention, a method 200 of playing a senate card game may comprise the step of establishing rules of trading cards from a particular set of rules (Step 202). The set of rules may include trading any senate card with a particular class of Senator for any other senate card with the same particular class of Senator (Step 204); trading a senate card with a Senator of a player's state of residence for any other senate card with a Senator of another state (Step 206); trading any senate card with any Senator of any state of any party for any other Senator card with a Senator (Step 208); and trading senate cards of one Congress with senate cards of another Congress (Step 210). The trading of senate cards may include trading senate cards of any present or future Congress with any senate card from any previous Congress beginning with the 109$^{th}$ Congress.

The set of rules may further include trading a President card during any present or future Congress for any other President card of any previous Congress beginning with the 109th Congress. Additionally the set of rules may include trading a Vice President card during any present or future Congress for any other Vice President card of any previous Congress beginning with the 109th Congress.

For the exemplary purposes of this disclosure, the following includes a set of rules and instructions of game play in accordance with particular embodiments of the present invention.

United States Senator Playing and Trading Cards

109th Congressional Inaugural Series

Contents: 102 trading and playing cards in a tuck box Rules for play or trade between 2 players A. 100 U.S. Senator portrait cards beginning with the 109th US Congress B. 1 portrait card of the current President of the United States of America C. 1 portrait card of the current Vice President of the United States of America 1. Each player plays for either the Republican or Democrat chamber of the Senate. The 1 Senator elected by the Independent party caucuses/meets with the Democrats, and therefore is included with the Democrats for facilitation of playing.
   - In the Inaugural series of 2006, there are 55 Republicans, 44 Democrats, and 1 Independent Senator elected to represent all the people in the United States of America. Two Senators are elected from each of the 50 states
   - The Republican side has 55 Senators. The Democrat side has 45 Senators.
   - The Letters R for Republican; D for Democrat; I for Independent are located on the upper left corner of the card.
   - Players may by agreement play for either party. When players do not agree and want to play the same party, one player takes two Senator cards from each of the Republican and Democrat parties, shuffles them, and places them face down on the table. The other player chooses one of the cards. The party of the Senator drawn is the party that player will use in this game. The second player plays the other party.
2. A game may end at any level of play as agreed by both players.
   - Basic Level Age 9 years—Adult: Play is based only on comparing the values on each Senator's card. See Playing the Game: 1; 2; 5; 6; and Card Values: A:2 only; B, C, D.
   - The U.S. President and Vice President are the only cards placed face up. The Senator having the highest value per class/year/or electoral vote takes the other Senator to his side of the Senate. See Executive Branch/Vice President for breaking a tie. Players agree to the length of time they will play. At the end of that time, the side of the Senate having the most Senator cards on the Senate floor and in committee wins.
   - Level 1: Age—12 years-adult: Levels 1, 2, and 3 use rotation of value elimination, office value, and parliamentary strategies.
   - The goal of Level 1 is to win a majority of the whole Senate to his party's position in order to create a bill that will be submitted to the U.S. House of Representatives. Players may choose to end this game at this level if:
     - A. Either Party has ⅔ {66} members of the Senate in both their committee and on their side of the Senate floor.
     - B. Either side's total count of the Senators in their committee and on their side of the Senate floor is 34 members or less.
     - The player having the ⅔ majority of Senators on his side is considered the winner. The winning side is considered the winning party and the initiator of the bill.
     - C. Senate recess: Senators call for a break/recess and return later to finish the work of the Senate. There is no winner, and the game is not finished.
   - Level 2. To submit the bill approved by Congress to the executive branch {President and Vice President} and have the bill signed into law by the President of the United States.
   - Level 3. If the President vetoes the bill, says no to it and returns it to Congress unsigned; the goal is to pass the bill by a Senate override of the President's veto.
   - Preparing your side of the Senate for Levels: Basic 1, 2, and 3
   - Senators are elected for a term of 6 years. Their terms are assigned classes of overlapping election cycles: Each Senator is up for re election in the expiration year of his class.
   - Class I expire in 2007; Class II expire in 2009; Class III expire in 2011.
   - Class I, II, or III is located in the upper right hand corner of each playing side.
   - Before beginning a game, players may trade any Class I Senator for another.
3. The U.S. Vice President is the President of the Senate. The Senate elects a Senator of the majority party with the longest record of continuous service to substitute for him in his absence from the Senate. That Senator is called the President Pro Tempore, "President for a Time", of the Senate. The President Pro Tempore can become the President of the United States if there is a vacancy in the Presidency and both the Vice President of the U.S. and the Speaker of the U.S. House of Representatives are unable to fill that position. The President Pro Tempore chooses new Senators from his party to substitute for him when he is absent from the Senate. Whoever is playing the side of the majority party, shows the President Pro Tempore Senator card {see Pres. Pro Temp., left-hand corner} and places him anywhere in his Senate floor deck. The player on the minority side names and shows his choice of 1 Senator, who holds no other office, to be his President Pro Tempore. That Senator's card is placed any where into the minority party deck called the Senate floor.
4. The U.S. President's and Vice President's cards are removed from their party and placed face up in an area designated the Executive Branch. This series begins with the 43rd President and Vice President of the United States. The left date is the year they were elected to office. The right date is the year their term ends. The Executive branch can only remain in office 8 years and must be re elected after 4 years to the second term. There is no limit to the number of years a Senator can hold office.
5. The Majority Leader and Majority Whip are removed from their party and placed face up on the side of the majority party: i.e. series 2006 majority party is Republican. MA L or MA W are listed under R in the left hand corner. {not face up in basic play}

6. The Minority Leader and Minority Whip are removed from their party and placed face up on the side of the minority party: i.e. series 2006 minority party is Democrat. MI L or MI W are listed under D in the left hand corner. {not face up in basic play}
7. Each player puts his remaining cards into any order he chooses, face down, into one deck in front of him. This deck is called the Senate Floor. The order of these cards can not be changed after the game begins, nor can they be recorded or looked at during the game, unless the parliamentary process calls for it.
8. The card played from the top of each player's Senate floor is the only card in play at any time! All other cards are face down when on Senate floor or in committee.

Exceptions are:

1. President and Vice President's cards
2. Majority Leader and Majority Whip {down at basic play level}
3. Minority Leader and Minority Whip {down at basic play level}
4. Expelled Senators {not used at basic play level}

Playing the Senate Game:

1. Each player simultaneously turns the top card face up from his Senate floor. {In the Senate, there are 2 sides to the Senate chamber. The floor of the Senate is where a Senator is recognized to speak to the whole Senate. Each player's Senators represent his party's side of the whole Senate. The Senators in play represent the Senator speaking on the Senate floor from each player's side.
2. The following items of information on a Senator's card have been assigned value. Before the game begins, both players can agree to any rotation of evaluation elimination pertaining to class, year, or electoral count. {class . . . electoral . . . year} {.year . . . electoral . . . class} {electoral . . . year . . . class} etc. This cannot be changed once game begins.

The Senator having the highest value on any item in rotation takes the opposing Senator card and puts both cards face down in a separate pile on his side called the committee. Each player will have a Senate floor {active play} and a committee. When all of a player's Senators' cards from the Senate floor have been played, his Senate Committee becomes his next Senate floor. Play continues and is always from the Senate floor.

For a tie, see Executive Office: Vice President/President of the Senate

A card's value is determined by:

A. Office/Value
   1. President can sign a bill into law or veto a bill.
   2. Vice President can vote to break a tie as President of the Senate
   3. Senate Majority Leader/Majority Whip can filibuster {1× each}
   4. Senate Minority Leader/Minority Party Whip can filibuster {1× each}
   5. Each side's President Pro Tempore can call for a quorum only 1× each.

B. Class/Value: {I, II, III is located in the upper right corner of the card}
   1. Senator's Class I takes Class II or Class III.
   2. Class II takes Class III.
   3. Class III takes none.

Player's Option: During any Congressional year, if a Senator leaves office, changes his party, loses an election, or dies; his Senator card's class value remains the designated Class on his card, unless both sides mutually agree to modify the value of the class based on the newly appointed or newly elected Senator who will take office now or in the next Congress. That Senator's Class value then becomes III and is played as such. This must be agreed to before the game begins!

A player may modify any values on his Senator's card to correspond to current events. This must be agreed to before play begins!

C. State's Electoral College Votes {located on the bottom right of the card.} The state with the highest Electoral College vote count wins. The Electoral College is a body of electors that elects the President and Vice President of the United States. Each state's number of votes equals the total number of U.S Senators and U.S. House of Representatives from that state.

D. Year Entered Senate office {Year is located in lower left corner}. This is the date the Senator's first term in the Senate began. The earliest year wins.

Executive Office

A. U.S. President's Card has the Power to Sign or Veto a bill into Law. The President's card remains face up throughout the game. If a player believes there are ⅔ {66} of the Senators present on both sides of the Senate floor, he may submit a bill to the President for approval by being first to say, "Mr. President" before either Senator playing card is turned. Only those Senators on the total Senate floor are counted {face down and in order.}

There must be 66 in order to continue. If there are not 66, the player submitting the bill loses his next Senate playing card to the opposition and that card goes to the bottom of the opposing committee.

1. If there are ⅔ {66} Senators on the Senate floor, and the bill is submitted by the side that is the President's party, the bill is passed. That player wins the game.
2. If the bill is submitted by the opposing party, the bill is vetoed.
3. The opposing party may call for an Override. If there are ⅔ {66} of the Senators on the total Senate floor, the player is allowed to turn over all the Senator cards on both sides of the floor. Keeping them in the same order, he counts to see how many are Republican and how many are Democrat.

If there is a majority of the ⅔ or more of the Senators on the total Senate floor from the President's party {34 if there are 66 Senators on the total Senate floor} the bill passes. The player calling for the Override wins the game. If this majority is not there, that player's next Senate playing card goes on the bottom of the opposition's committee. Play continues until a bill is approved by the President or a Presidential veto is overridden B. The U.S. Vice President is the President of the Senate and votes to break any tie vote that comes before the Senate.

When 2 Senators are played and their evaluation is tied, the Vice President will vote to break the tie in favor of the side of the Senate that represents his party. That player takes both cards and places them face down on the bottom of his committee.

Parliamentary Strategies

Rotation Evaluation is not used. The strategy to be used must be called out before any Senator card is turned up on the Senate floor by one of the players.

Exception: See Censure and Quorum

A. Filibuster: "an unlimited debate", used to delay or block Senate action. This can only be called 4× in the game; 1× by each Majority/Minority Leader or Majority/Minority Whip.

The player designates which of his Majority or Minority Leaders is filibustering. Each player takes the next 6 cards from his Senate floor and puts them face down into a pot. The next 2 Senators on the Senate floor are turned over. The card of highest value takes all 12 cards. They are put face down on the bottom of the winning side's committee.

The Majority or Minority Leader/Whip that called the filibuster is removed to the bottom of his party's Senate floor.

B. Cloture: A procedure used to force the end of a filibuster. ⅗ vote {60} of the opposition is needed to block a filibuster. The opposing side may call for cloture if he has 60 Senators on the Senate floor. The player counts only the cards on the Senate floor. They are kept in order and counted face down. If cloture succeeds, each Senator's card in play goes to the bottom of his own committee. Once the filibuster is called, the particular Leader or Whip cannot call for a filibuster again.

C. Expulsion: Senate removal of a Senator from office for disorderly behavior. If a player thinks there are ⅔ {66} of all the Senators present on both sides of the Senate floor, he may name and call for the expulsion of any Senator. Both Senate floors are counted and if the total present is 66 Senators or more, the Senator named is removed from the game and placed face up outside of the Senate floor. Expulsion may be called for only a total of 1× in a game by each side.

D. Censure: Senate statement of disapproval of a Senator {not removal from office}. At any time, any Senator may call for the censure of another Senator if he has ⅔ {66} Senators on the Senate floor. As both sides turn up their top cards, one side may call for a censure of the opposing Senator in play on the floor. The total Senate floor {both sides} is counted face down and without changing rotation. If there are 66 Senators on the total floor, the censured Senator goes to the bottom of his side's committee. He is not moved from his side of the Senate.

E. Quorum: Minimum number of Senators needed to conduct Senate business. Before the game begins, each player is to name a Senator, who is holding no other office, to be the President Pro Tempore. This Senator can call for a quorum. The call for a quorum can only be used 1× by each President Pro Tempore. This call is for a count of the total number of Senators present on both sides of the Senate. The total Senate is to have 51 Senators on the Senate floor to do the work of the Senate. When a Senator is in committee, he is not in the Senate chamber. Both sides count only the Senate floor cards that are face down and the 2 in play without changing the order of the cards. If there are not 51 in total on both sides, the player calling for a Quorum may draw a card from anywhere in the opposite side's committee floor. That Senator is placed at the bottom of his or her President Pro Tempore's Senate floor. If both players' designated President Pro Tempore are turned simultaneously, their cards are put on the top of each player's committee and the call for a quorum is not used. Play resumes with the next 2 Senators on the floor. A quorum may be called the next time a player's designated President Pro tempore is played.

If a player loses his designated President to the other side, none other can be designated. If a player wins back that officer, a quorum can be called when that Senator is played. Once the Presiding Officer calls a quorum, that Senator no longer holds that office and is then played according to the rotation of evaluation. A quorum can not be called during a filibuster.

To facilitate playing the different levels of this game:

A. Each Senator through the course of play becomes bipartisan; being in agreement with the opposition and working with the opposition in order to do the work of the Senate.

B. Each Senator when in play is debating or voting.

C. When a Senator is taken by the opposite party's side, assume that he supports the position of that party.

D. When the Senate presents a bill to the President to sign, assume that the U.S. House of Representatives has approved it.

E. Any Senator has the right to filibuster. Majority and Minority leaders and whips were chosen for facilitation of play.

F. When parliamentary strategies fail, the Senate game continues until the strategies are tried again.

G. The President Pro tempore usually chooses new members of his majority party to substitute for him in presiding over the daily business of the Senate during his absence. In this game, the minority party is also given this opportunity.

H. Since a Senator that represents the Independent Party traditionally has no party base in the Senate, he must determine which party {minority or majority} he will caucus/meet with on the Senate floor. In the 109th Congress, that choice has been for the Democrat Party. Players may continue with that position in the game, or may, before sides are chosen, assign the Independent Party Senator to be on the Majority Party side. This must be agreed to before choosing one's party of play.

I. Assume that when the U.S. President considers a bill, he agrees with his party's majority or a bipartisan majority. In reality, some Presidents will veto a bill whether the bill is supported by a majority of his party or a bipartisan majority.

When a President vetoes a bill, Senators from his party usually will not support an override, even though they may have supported the initial bill. This is why the position is taken requiring the majority who override the veto to be from the President's party.

Many Presidents and Senators, since the founding of our country, have made their choices based on faith in God and their conscience before the Lord. Others' choices have been based on their conscience; political perspective; peer pressure; polls; tradition; party directive; media coverage; or re election concerns.

Trading the 109th Congressional and Executive Cards/series 2006

Goal: To create one's Ideal Senate and Executive Branch

Owner may trade any Class 1 Senators for any other Class 1 Senators.

Owner may trade only Senators of his state for Senators of another state.

Owner may trade to duplicate the Senator or Senators of his state in all 50 states.

Owner may trade any Senator regardless of state or party for any other Senator.

Owner may recreate any future Senate, beginning with the 110th Senate {series 2007} and any Congress thereafter, by replacing any or all Senators in each new Congress with any Senator from a previous Congress, beginning with the 109th.

Owners may trade the 44th President and 44th Vice President {2009 series} for the 43rd President and 43rd Vice President {2006 Inaugural Series, 2007 and 2008 series} and may trade any future President/Vice President for any previous executive branch dated no earlier than this 2006 Inaugural series.

At any time, the Senate game may be played with the current Senate and Executive series or the ideal created by trading.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A method of playing a senate card game between a plurality of players, the method comprising the steps of:

separating senate cards into a first and second stack, wherein the separation is dependent upon political parties and the first stack has a greater number of cards than the second stack, the first stack forming a majority stack and the second stack forming a minority stack;

providing a predetermined time of game play placing each stack of senate cards face down on a playing surface;

flipping a card from a top of each stack showing a Senator of each card flipped;

winning a senate card of lesser value, wherein the value of each card is determined by value factors including at least one of office, class, year, electoral count and combinations thereof;

determining a winner, wherein the winner is the player with the most senate cards at the expiration of the predetermined time of game play;

determining a bill submitting party after expiration of a predetermined time of game play by a player having ⅔ of the senate cards on the player's side;

submitting a bill by the submitting party for approval; and performing an action by a President card of passing the bill or vetoing the bill, wherein the bill passes if the submitting party is the same party as the President card and the bill is vetoed if the submitting party is a different party as the President card.

2. The method of claim 1, wherein the step of separating the senate cards into stacks further includes the steps of:

removing a Majority Leader card, a Majority Whip card, a Minority Leader card and a Minority Whip card from the senate cards; and placing the Majority Leader card, the Majority Whip card the Minority Leader card and the Minority Whip card face up in a predetermined area.

3. The method of claim 1, wherein the step of separating the senate card into stacks further includes the steps of:

removing a President Pro Tempore card from the senate cards;

showing the President Pro Tempore card before placing it face down in the majority party stack of the stacks of senate card;

selecting and showing a senate card from the minority party stack of the stacks of senate cards;

designating the senate card from the minority party stack as a President Pro Tempore for the minority party; and placing the senate card designated as President Pro Tempore for the minority party face down in the minority party stack.

4. The method of claim 1, further comprising a preliminary step of trading senate cards having Senators with a predetermined class for other senate cards having Senators with the same predetermined class.

5. The method of claim 1, wherein the value of each card determined by office includes at least, in order of greatest value to least value, President, Vice President, Majority Leader, Majority Whip, Minority Leader, Minority Whip, and President Pro Tempore.

6. The method of claim 1, wherein the value of each card determined by class includes at least, in order of greatest value to least value, Senator class I, Senator class II, and Senator class III.

7. The method of claim 1, wherein the value of each card determined by electoral count includes a value assigned to a senate card equal to the number of electoral votes of a state represented by a Senator on the senate card.

8. The method of claim 1, wherein the value of each card determined by year includes a value assigned to a senate card dependent on a year a Senator on a senate card entered senate office, wherein the year that is the earliest has a greater value.

9. The method of claim 1, wherein the step of winning a card of lesser value includes a preliminary step of establishing a rotation or order of the value factors considered to determine which card has a greater value.

10. The method of claim 1, further comprising performing a tie breaker if cards flipped over have equal value, the tie breaker being determined by a Vice President card, wherein the card flipped having the same party as the Vice President card is determined the winner.

11. The method of claim 1, further comprising overriding the vetoed bill if ⅔ of the senate cards in play indicates a party that is the same as the President card.

12. The method of claim 11, further comprising determining a winning player from at least one of the submitting party that successfully passes the bill and the player that overrides the bill.

* * * * *